US006948885B2

(12) United States Patent
Blazevic

(10) Patent No.: US 6,948,885 B2
(45) Date of Patent: Sep. 27, 2005

(54) METHOD FOR CONSTRUCTING FOUNDATION

(76) Inventor: Paul Blazevic, 35 Britannic Crescent, Sovereign Island, Queensland 4216 (AU)

( * ) Notice: Subject to any disclaimer, the term of this patent is extended or adjusted under 35 U.S.C. 154(b) by 0 days.

(21) Appl. No.: 10/506,655

(22) PCT Filed: Mar. 7, 2003

(86) PCT No.: PCT/AU03/00274

§ 371 (c)(1),
(2), (4) Date: Sep. 7, 2004

(87) PCT Pub. No.: WO03/074796

PCT Pub. Date: Sep. 12, 2003

(65) Prior Publication Data

US 2005/0129465 A1 Jun. 16, 2005

(30) Foreign Application Priority Data

Mar. 7, 2002 (AU) ..... PS 0960

(51) Int. Cl.[7] ..... E02D 5/00

(52) U.S. Cl. ..... 405/230; 405/229; 405/235; 52/169.9

(58) Field of Search ..... 405/229–231, 405/235, 244; 52/169.9, 236; 249/3, 20; 264/34

(56) References Cited

U.S. PATENT DOCUMENTS

| | | | | | |
|---|---|---|---|---|---|
| 1,827,921 | A | * | 10/1931 | White | 405/230 |
| 3,040,411 | A | * | 6/1962 | Messenger | 405/229 |
| 3,091,938 | A | * | 6/1963 | Schnabel, Jr. | 405/230 |
| 5,123,209 | A | * | 6/1992 | Nally | 405/230 |
| 5,522,676 | A | * | 6/1996 | Gryba | 405/134 |
| 5,697,734 | A | | 12/1997 | Verstraeten | |
| 6,352,390 | B1 | * | 3/2002 | Jones | 405/230 |

FOREIGN PATENT DOCUMENTS

| | | | |
|---|---|---|---|
| DE | 3716750 | A | 12/1988 |
| GB | 2219021 | * | 11/1989 |
| JP | 08-003986 | A | 1/1996 |

* cited by examiner

*Primary Examiner*—Jong-Suk (James) Lee
(74) *Attorney, Agent, or Firm*—Buckingham, Doolittle & Burroughs, LLP; David P. Dureska; Edward T. Kennedy

(57) ABSTRACT

A method of construction includes positioning at least one support member (2) in the ground, forming a foundation (4) substantially adjacent the at least one support member, excavating ground beneath the foundation to a prescribed depth below the surface (5) temporarily forming cavities or voids (8) and supporting bridges (10) beneath the foundations, excavating the supporting bridges and dropping the formed foundation to the prescribed depth. Structures such as walls (12) may be constructed on the foundations prior to dropping the foundations and bracing members (22) may be used to prevent deflection of the walls.

14 Claims, 6 Drawing Sheets

METHOD FOR CONSTRUCTING FOUNDATION

CROSS REFERENCE TO RELATED APPLICATION

This application is a national stage of PCT/AU03/00274 filed Mar. 7, 2003 and based upon AUSTRALIA PS 0960 filed Mar. 7, 2002 under the International Convention.

FIELD OF THE INVENTION

The invention relates to a method of construction. In particular, although not exclusively, the invention relates to a method of constructing and installing a structure, such as a building foundation. The method is particularly applicable to forming and positioning foundations on building sites and in particular on sites composed of soft ground material and/or where the effects of water are problematic and/or where extensive excavation would ordinarily be required.

BACKGROUND TO THE INVENTION

Conventionally, foundations for buildings are often constructed by excavating a site to a required depth, at which, settable material, such as concrete is laid. The foundations may take various forms depending on the composition of the ground on which the building is to be constructed, the design and function of the building and the height to which the building will extend.

In the case of large buildings such as office complexes, skyscrapers and the like, often foundation piles are driven deep into the ground using a variety of known methods and a variety of pile designs, the particular method depending on at least some of the above factors. For example, some piling methods utilise prefabricated pile shafts screwed into the bearing ground layer, such as those disclosed in U.S. Pat. No. 5,697,734 assigned to Beheersmaatschappij Verstraeten B. V.

On sites where the ground is soft and/or there are problems with the presence of water in the area being excavated or where foundation piles are being driven, such as on many coastal sites or sites located near rivers or other bodies of water, piles sometimes have to be driven to incredible depths, and/or very deep excavations made, before a suitable bearing ground layer is reached. This is not only highly inefficient because of the time and expense associated with the need to excavate such huge volumes of material and/or to pile to such depths, but it is also potentially very dangerous for those working on the site. Furthermore, the stability of neighbouring sites and buildings are put at risk because of the inordinately deep excavations and/or piling.

Hence, there is clearly a need for a construction method that addresses or at least ameliorates some, if not all, of the aforementioned problems associated with the prior art construction methods and/or provides a viable commercial alternative to the prior art methods.

DISCLOSURE OF THE INVENTION

In one form, although it need not be the only or indeed the broadest form, the invention resides in a method of construction including the steps of:

a) positioning at least one support member;

b) forming a foundation substantially adjacent the at least one support member;

c) excavating ground beneath the foundation to a prescribed depth; and d) dropping the formed foundation to the prescribed depth.

Step c) may further include the step of partially excavating the ground beneath the foundation to temporarily leave at least one supporting region of ground in contact with and supporting the foundation. Suitably, a plurality of such supporting regions may be temporarily maintained beneath the foundation separated by excavated regions of ground.

Dropping of the formed foundation may be guided by the at least one support member and/or a wall of the excavation created in step c).

Suitably, the method includes repeating steps c) and d) until a desired depth for the foundation is reached.

Suitably, prior to performing step c), a structure, such as a wall or the like, may be constructed on one or more sections of the foundation.

Suitably, the at least one supporting member may be a pylon, a pile, a hollow tube, a hollow tube filled with settable material, a H-frame, a beam or the like. Where a plurality of supporting members is employed, one type or a combination of types of supporting members may be employed.

Suitably, the foundation may be formed in one or more segments, at least one support member being provided for each said segment. Preferably, an expansion/contraction joint is provided between adjacent segments of the foundation.

Suitably, the wall created by step c) may be prevented from deflecting by one or more bracing means.

Suitably, a structure, such as a wall, formed on the foundation is prevented from deflecting by one or more bracing means.

Suitably, the bracing means is a bracing member, A-frame, beam or the like.

Where the term "foundation" is used in this specification, it will be appreciated that this term includes structures such as walls and more particularly, walls that may function as a foundation.

Further features of the invention will become apparent from the following description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

DETAILED DESCRIPTION OF THE INVENTION

Figure 1A:
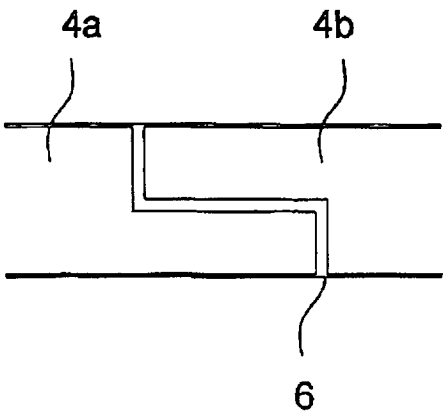
FIG. 1A is a schematic representation of an example of a joint between adjacent segments of foundation.
Figure 1:
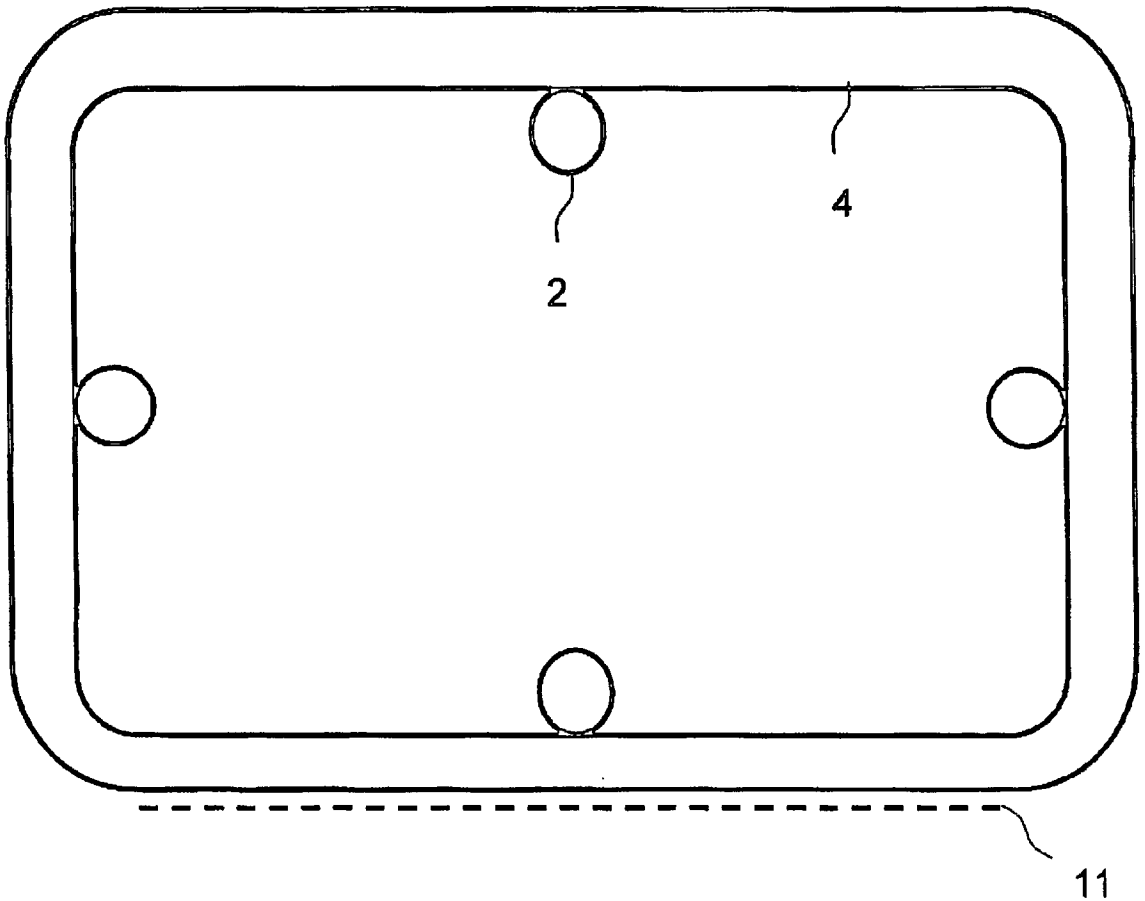
FIG. 1 shows a schematic plan view of a building site employing the method of the present invention.

In accordance with the present invention and with reference to FIG. 1, one or more support members 2 are positioned in the ground of the site. The support members may be foundation piles or pylons that are driven into the ground in accordance with a known method using known pylons. The pylons are preferably driven into the ground at locations corresponding to positions of pylons in the final building, such as around lift shafts and/or around or adjacent the perimeter of the finished building and similar significant load-bearing locations.

Alternatively, the support members 2 may be formed from hollow tubes, such as lightweight cylinders or the like, that are driven or forced into the ground. The hollow tubes may be manoeuvred into position prior to filling the hollow tubes with concrete or other settable material. Such hollow tubes are often used in soft and/or sandy ground.

As yet further alternatives, the support members inserted or otherwise positioned in the ground may be simple beams or H-frames or similar, which are familiar to persons skilled in the art, and may be formed and positioned in the ground according to known techniques.

According to the method of the present invention, a conventional foundation 4 made from, for example, settable material such as concrete, is constructed at the surface 5 of the site adjacent the one or more support members 2 in accordance with known techniques. The foundation 4 may be constructed around the perimeter of the ultimate location of the building, as shown in FIG. 1, or wherever the building foundation is required. For example, the foundation may be L-shaped, cross-shaped or some other shape. The foundation may be constructed in sections, with adjacent sections interlocking with each other according to known methods. For example, adjacent sections 4*a* and 4*b* of foundation may be stepped, as shown in FIG. 1A, with an expansion/contraction joint 6 between adjacent sections.

Hence, no initial excavation is required prior to laying the foundation and the support members may be formed in the ground to conventional, relatively shallow depths, as discussed below.

Figure 2:
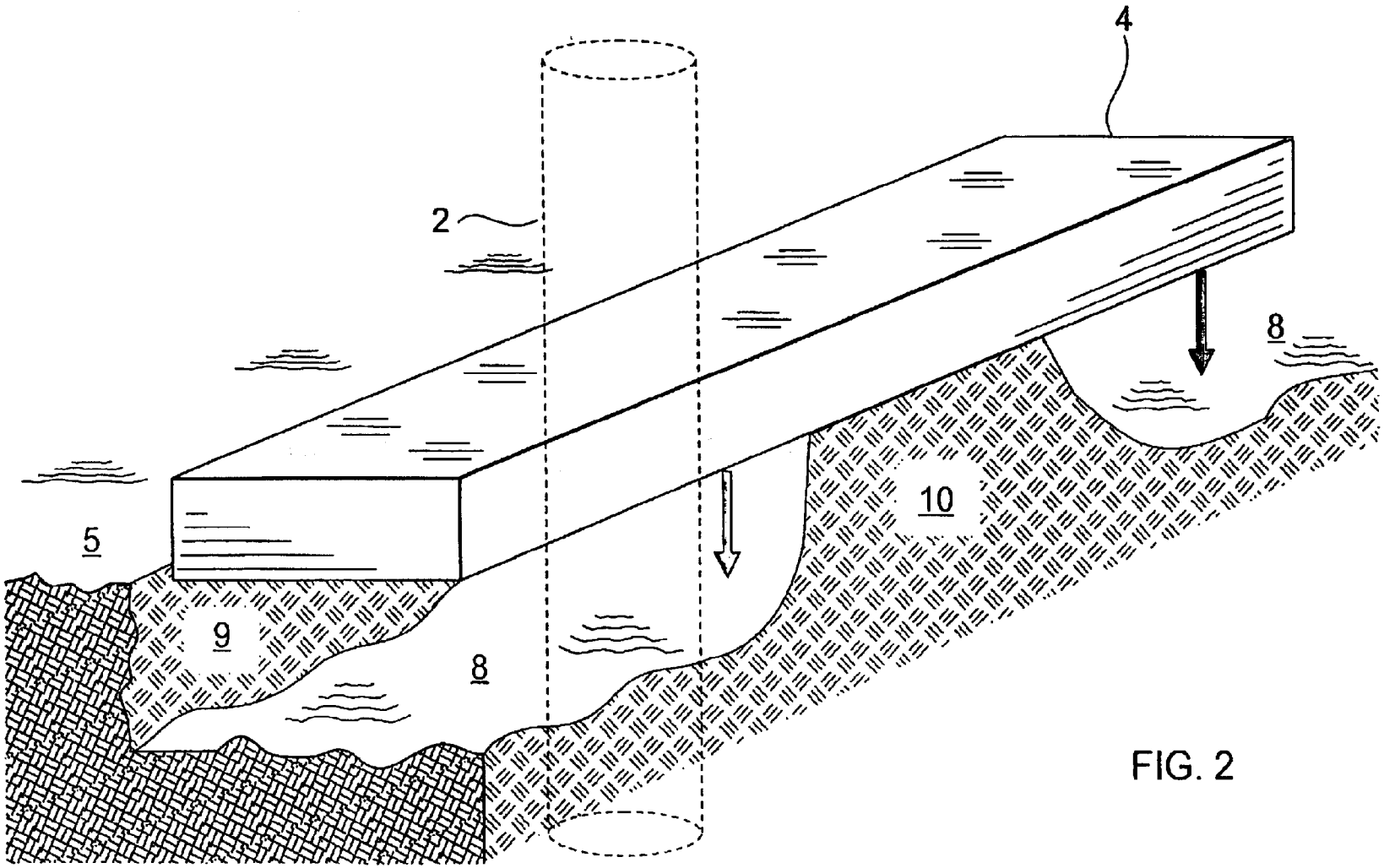
FIG. 2 shows a schematic representation of site excavation according to the present invention.
Figure 4:
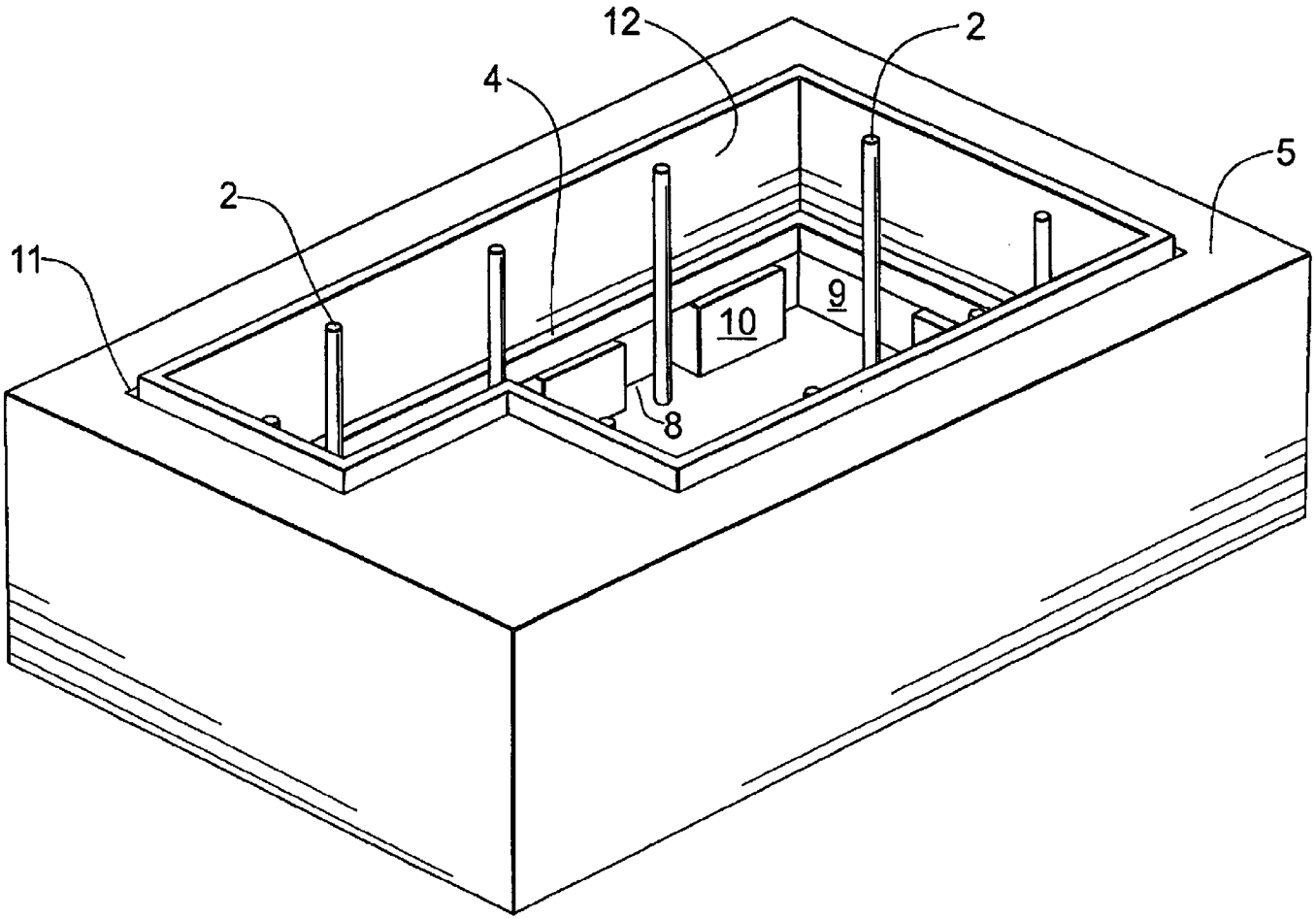
FIG. 4 shows a perspective view of a building site employing the method of the present invention.
Figure 6:
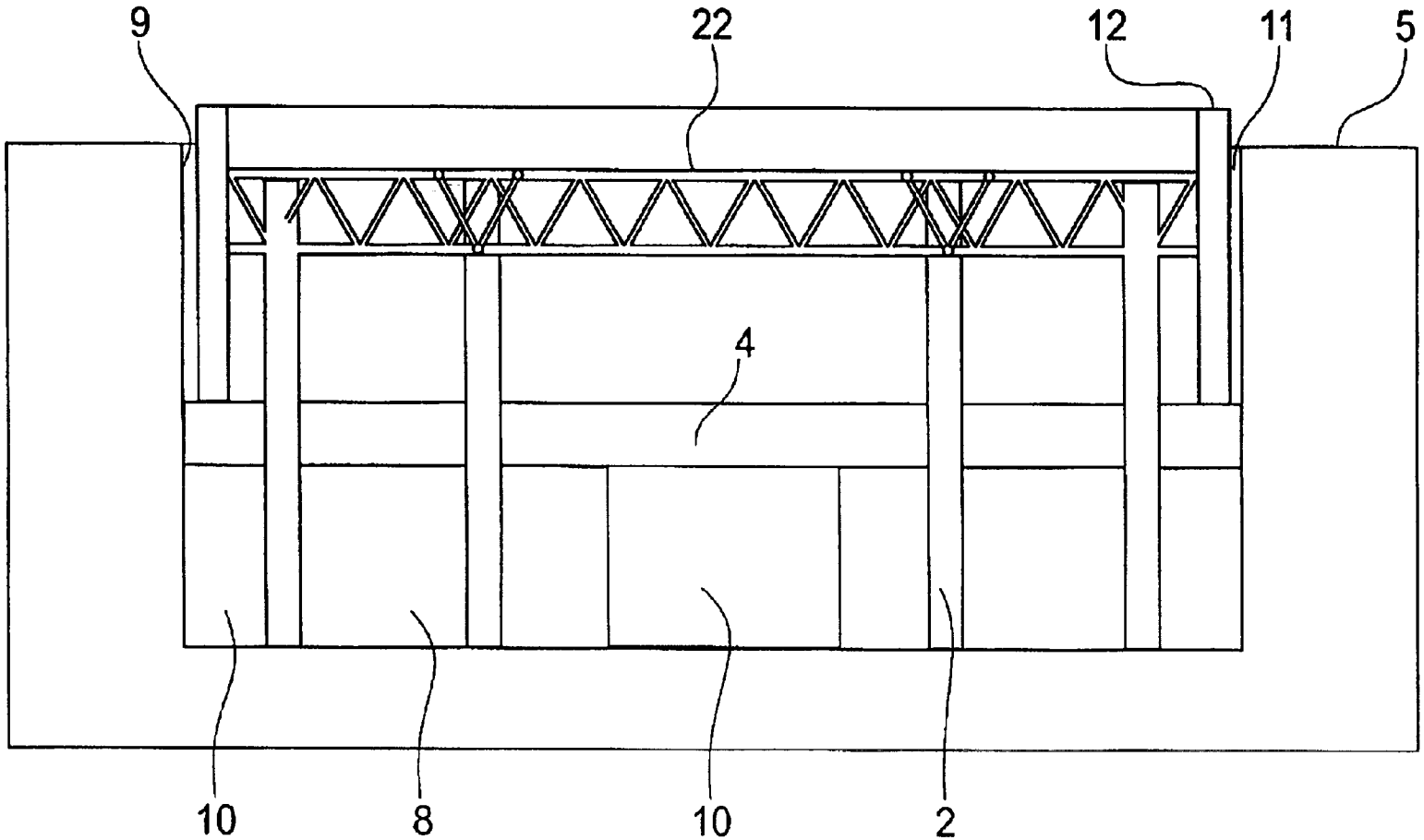
FIG. 6 is a sectional view of the building site shown in FIG. 5.

With reference to FIGS. 2, 4 and 6, regions of earth constituting the site are then gradually excavated from beneath the foundation 4 to create cavities or voids 8, except at a number of strategic locations beneath the foundation, where linking or support bridges 10 of earth are maintained. Between support bridges 10, the earth is excavated substantially evenly to a specific depth. Earth is also excavated from region 11 adjacent the foundation 4, for example, to a width of about 100 mm on one side of the foundation, as represented with the aid of the dotted line in FIG. 1.

Once a plurality of regions of earth have been excavated such that foundation 4 is supported by bridges 10 separated by voids 8, support bridges 10 are then initially weakened by partially excavating the support bridges. As the earth of support bridges 10 beneath the foundation 4 is gradually removed, the mass of the foundation above collapses the remaining material of the support bridges 10 causing the level of the foundation to drop in the direction of the arrows shown in FIG. 2 to the new level of the excavated earth beneath. The orientation of the foundation 4 relative to the site is maintained by virtue of the limited, approximately 100 mm wide, excavation on one side of the foundation, as described above, and by virtue of the one or more support members 2 on the other side of the foundation, both acting as guides for the foundation as it drops to the new level. Support members 2 are preferably provided for each section of foundation 4 to be dropped.

If the foundation is to be dropped to, for example, about 3 meters below the surface, supporting members 2 may be formed in, or otherwise inserted into, the ground to a depth of, for example, about 6 meters below the surface 5. The aforementioned specific depth to which the earth is excavated therefore corresponds to the new depth to which the foundation will be dropped. It will be appreciated that the method of the invention is not limited to these depths.

The above excavation process may then be repeated to drop the foundation to a greater depth if required. This process can be continued until the desired foundation depth is achieved. As the depth of excavation increases, bracing means such as supporting braces or bracing members 22, A-frames (not shown), beams or the like may be used to prevent walls 9 of the excavation adjacent the foundation, from deflecting. Walls 9 are shown in FIGS. 2, 4 and 6.

The width of supporting bridges 10 and the number thereof beneath the foundation 4, or sections of foundation, will depend on the dimensions and composition of the foundations and on the composition of the ground. Where harder ground material is present, the supporting bridges can afford to be narrower than the width of supporting bridges required with softer ground material. It will be appreciated that the method of the invention is not limited to support bridges 10 and/or voids 8 being of the same dimensions or being at regular intervals. These may differ according to, for example, ground conditions and foundation dimensions.

The size of supporting bridges 10 may also increase with depth. For example, for a section of concrete foundation about 2 meters long and about 1.5 meters wide to be dropped to a depth of about 3 meters, a supporting bridge of, for example, approximately 1 meter wide and the same width as the foundation 4, located about the midpoint of the foundation, may be sufficient to support that section of foundation, depending on the composition of the ground material. If the foundation is to be dropped to greater depths, the width of supporting bridges 10 will need to be increased.

Excavation of the supporting bridges may be facilitated by the use of suitably shaped excavating buckets (not shown). Such a bucket may have a width approximately the same as that of the supporting bridge with a substantially triangular cross-sectional shape. The shape of the bucket is such that more of the earth of the supporting bridges is removed at shallower depths closer to the foundation 4 than at deeper depths further away from the foundation. This causes the material of the supporting bridges to initially collapse closer to the foundation where the supporting bridge is weaker. The collapsing material to be excavated is then pushed out away from beneath the foundation. This method is particularly appropriate where the ground material is hard and potentially difficult to excavate.

Figure 5:
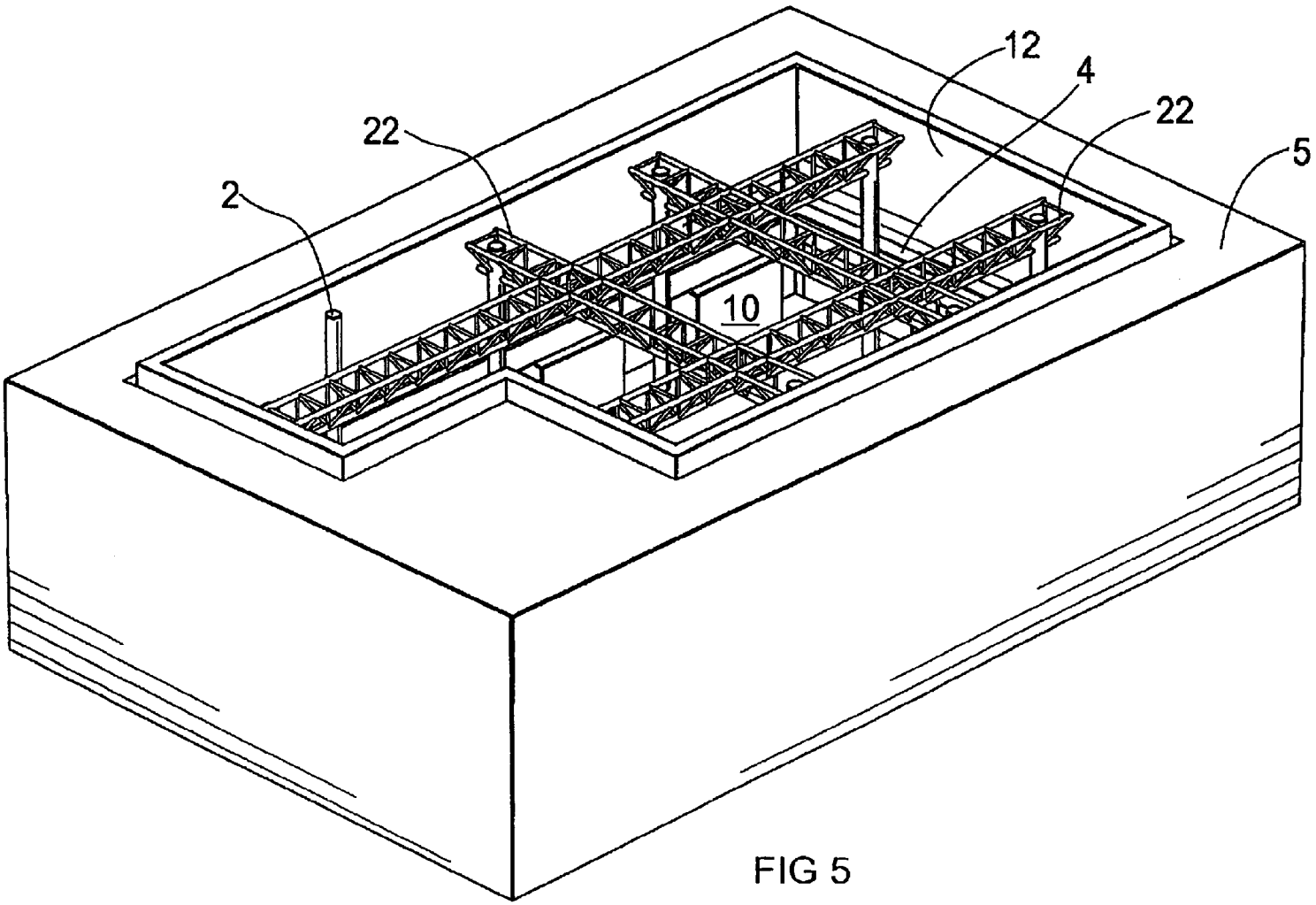
FIG. 5 shows the use of bracing means in the method of the present invention.

With reference to FIGS. 4–6, prior to excavating and lowering the foundation 4 to a new depth, a structure such as a wall 12 formed from, for example, a course of bricks or blocks, or from settable material such as concrete, or other structure, may be formed on at least a portion of the foundation 4. Hence, when the foundation is lowered to its new depth, the first level of wall 12 is already in place, preferably at least up to surface level 5, upon which the next level may be easily constructed. This obviates the need for workmen to work in confined and potentially dangerous subterranean spaces to construct the first stage of the walls on sunken foundations. Where a structure is constructed on the foundation prior to dropping, supporting bridges 10 may have to be larger in order to temporarily support the foundation and structure above. Bracing means, such as supporting braces or bracing members 22, A-frames (not shown), beams or the like, may be used to prevent deflection of walls 12.

It will be appreciated that on larger, or awkwardly shaped sites, it could be difficult to excavate evenly around the perimeter foundation, which could lead to, for example, cracking in the foundation if it were unevenly or uncontrollably dropped. Therefore, in accordance with the present invention and with reference to FIG. 3, the site may be divided into segments, such as segments 14, 16, 18, and 20. Each section may comprise its own guiding supporting members 2 and foundation 4. Once again, the foundation 4 of each segment may itself be formed in sections, as described above.

The earth beneath the foundation of each segment can be excavated, as described above, at its own rate, independent of the excavation rate of other segments on the site if necessary. The foundations of each segment can then be dropped when the excavation in that segment is ready, thus allowing each segment of the site to proceed at its own rate. This avoids progress on the whole site being hindered by, for example, excavation difficulties encountered in only one other segment.

Figure 3:
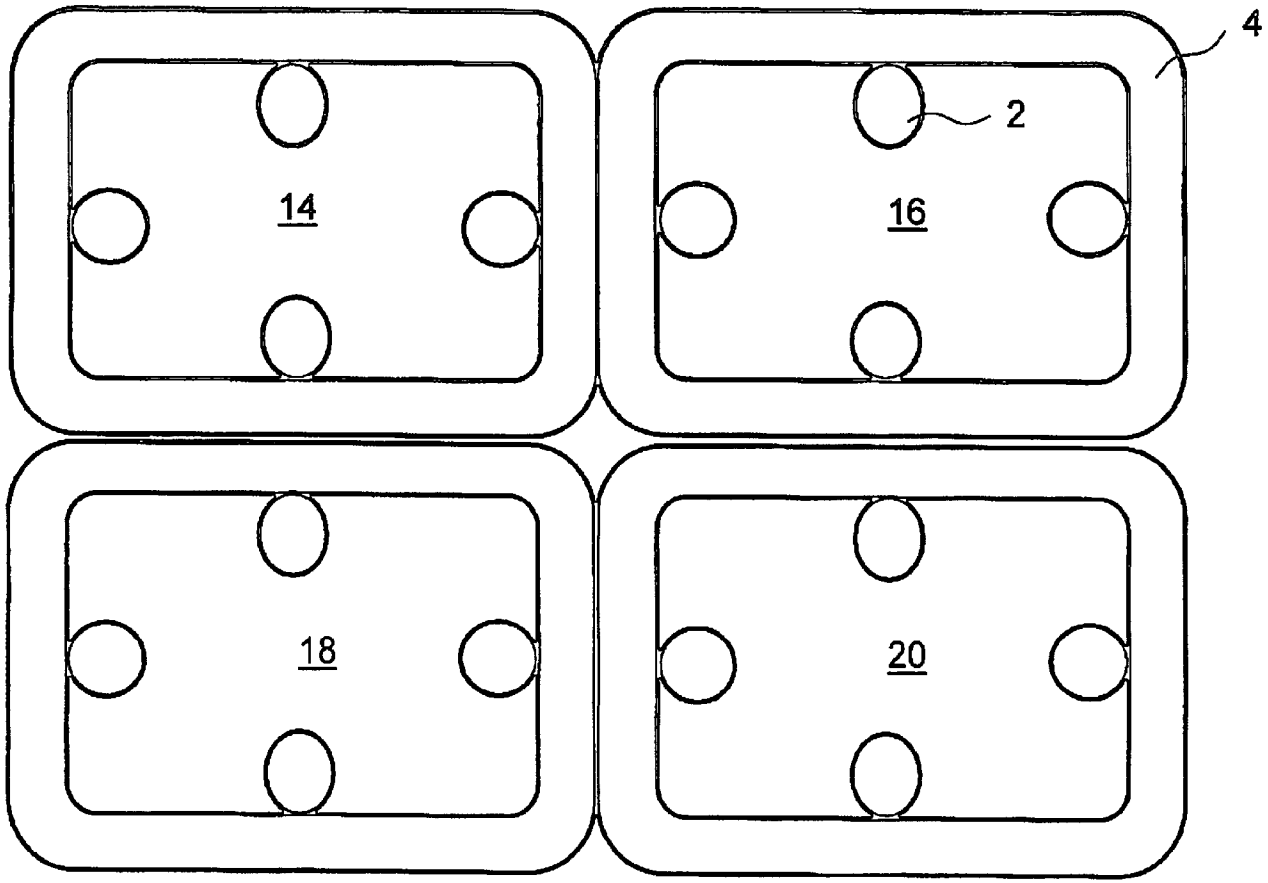
FIG. 3 shows another schematic plan view of a building site employing the present invention.

It will be appreciated by persons skilled in the art that although four supporting members 2 per foundation segment are shown in FIGS. 1 and 3, each supporting member being located approximately about the midpoint of each side of the foundation, a greater or lesser number of supporting members 2 may be utilized per foundation or per foundation section. The supporting members may also be positioned at alternative locations. Neither is the present invention limited to the supporting members being located within the foundation perimeter, as shown in FIGS. 1 and 3. The supporting members may alternatively be located outside the foundation perimeter, or a combination of inside and outside the perimeter. The locations of the supporting members may be influenced by factors such as the ground conditions, the type of foundation and/or the size and shape of the site.

The method of the present invention addresses the aforementioned problems of the prior art in that it is not necessary that supporting members 2 be driven to incredible depths from the surface 5 of the site. The foundation 4, wall 12 or the like only needs to be constructed at the surface 5 and dropped to the desired depth relative to, and guided by, the supporting members and the excavation itself.

Furthermore, excavation of the site is hugely simplified because only comparably small volumes of material need to be excavated at one time from the site to enable the foundation to be lowered a prescribed distance, before repeating the process as necessary. This avoids the prior art danger of having to excavate large volumes of material at one time, which increases the risk of collapse of the ground, the risk being amplified by the presence of soft/sandy ground material and/or the presence of water.

The method of the present invention is more rapid than prior art methods because time is not wasted in driving piles, pylons or the like from the surface 5 to great depths. Supporting members 2 only need to be driven or otherwise inserted into the ground to a depth that is sufficient to support dropping of the foundation 4 to, for example, the first or second new level, which may occur at, for example, 3 meters and 6 meters respectively. If the foundation is to be dropped further, the supporting members can then be driven further into the ground. However, the supporting members will be further inserted from a level that is already, for example, 3 meters or 6 meters below the surface 5, making the piling or similar process easier.

Excavation of the ground material is also assisted by the mass of the foundation 4 and any structure built thereon, such as walls 12, pressing down on the ground material, which helps force the ground material out from beneath the foundation.

The present invention could be applied to the preparation and installation of structures such as walls, foundations and the like, for a wide range of constructions. The present invention is particularly useful for the foundations of tall buildings that require substantial foundations, especially in locations with soft and/or sandy require substantial foundations, especially in locations with soft and/or sandy conditions and/or where the presence of water is a problem.

The present invention is also particularly applicable for the construction of underground car parks and the like, which are ubiquitous in modern buildings.

Throughout the specification the aim has been to describe the invention without limiting the invention to any one embodiment or specific collection of features. Persons skilled in the relevant art may realize variations from the specific embodiments that will nonetheless fall within the scope of the invention. For example, additional guiding means may be provided to provide further control over the descent of the foundation and increase safety of the method. For example, foundation 4 may be coupled to one or more support member 2, such as with a cable or the like coupled to foundation 4 and to a collar, the collar adapted to slide up and down support member 2 to restrain descent of the foundation once supporting bridges 10 have been removed.

What is claimed is:

1. A method of construction including the steps of:

a) positioning at least one support member;

b) forming a foundation substantially adjacent the at least one support member;

c) excavating ground beneath the foundation to a prescribed depth; and d) dropping the formed foundation to the prescribed depth.

2. The method of claim 1, wherein step c) further includes the step of partially excavating the ground beneath the foundation to temporarily leave at least one supporting region of ground in contact with and supporting the foundation.

3. The method of claim 2, wherein a plurality of such supporting regions are temporarily maintained beneath the foundation separated by excavated regions of ground.

4. The method of claim 1, wherein step d) further includes guiding the dropping of the formed foundation by the at least one support member.

5. The method of claim 1, wherein step d) further includes guiding the dropping of the formed foundation by a wall of the excavation created in step c).

6. The method of claim 1, further including repeating steps c) and d) until a desired depth for the foundation is reached.

7. The method of claim 1, wherein, prior to performing step c), a structure, is constructed on one or more sections of the foundation.

8. The method of claim 7, wherein the structure is a wall.

9. The method of claim 1, wherein the at least one supporting member is one or a combination of the following: a pylon, a pile, a hollow tube, a hollow tube filled with settable material, an H-frame, a beam.

10. The method of claim 1, wherein the foundation is formed in one or more segments.

11. The method of claim 10, wherein at least one supporting member is provided for each said segment.

12. The method of claim 10, wherein an expansion/contraction joint is provided between adjacent segments of the foundation.

13. The method of claim 1, wherein deflection of a wall created by step c) is prevented by one or more bracing means.

14. The method of claim 1, wherein deflection of a structure formed on said foundation is prevented by one or more bracing means.

* * * * *